US008418611B2

(12) United States Patent
Schoenberger et al.

(10) Patent No.: US 8,418,611 B2
(45) Date of Patent: Apr. 16, 2013

(54) PRINTING UNIT

(75) Inventors: Wolfgang Schoenberger, Schriesheim (DE); Dieter Schaffrath, Lorsch (DE); Hans Butterfass, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 327 days.

(21) Appl. No.: 12/960,992

(22) Filed: Dec. 6, 2010

(65) Prior Publication Data

US 2011/0132214 A1 Jun. 9, 2011

(30) Foreign Application Priority Data

Dec. 4, 2009 (DE) ..... 10 2009 056 993

(51) Int. Cl.
*B41F 31/00* (2006.01)
*B41F 31/26* (2006.01)

(52) U.S. Cl.
USPC ..... 101/349.1; 101/350.1

(58) Field of Classification Search ..... 101/349.1, 101/350.1
See application file for complete search history.

(56) References Cited

U.S. PATENT DOCUMENTS

| | | | | |
|---|---|---|---|---|
| 6,457,407 | B2 * | 10/2002 | Leib et al. | 101/145 |
| 6,668,724 | B2 | 12/2003 | Callahan et al. | |
| 6,886,461 | B2 | 5/2005 | Bolza-Schünemann | |
| 2003/0172824 | A1 * | 9/2003 | Bolza-Schunemann | 101/350.1 |

FOREIGN PATENT DOCUMENTS

| | | | |
|---|---|---|---|
| DE | 37 13 027 | A1 | 11/1988 |
| DE | 100 23 935 | A1 | 12/2001 |
| DE | 10 2006 050 746 | A1 | 4/2008 |
| EP | 0 870 609 | A2 | 10/1998 |

OTHER PUBLICATIONS

German Patent and Trademark Office Search Report, Dated Jun. 9, 2010.

* cited by examiner

*Primary Examiner* — Leslie J Evanisko
(74) *Attorney, Agent, or Firm* — Laurence A. Greenberg; Werner H. Stemer; Ralph E. Locher

(57) ABSTRACT

A printing unit contains a dampening unit and an inking unit which includes a screen roller with a circumference and an ink applicator roller with a circumference and a gap having an arc length or curve length, the ink applicator roller resting against the screen roller. The circumference of the screen roller and the circumference of the ink applicator roller and the arc length or curve length of the gap are dimensioned in predetermined proportions relative to each other so as to avoid ghosting.

4 Claims, 5 Drawing Sheets

PRINTING UNIT

CROSS-REFERENCE TO RELATED APPLICATION

This application claims the priority, under 35 U.S.C. §119, of German application DE 10 2009 056 993.6, filed Dec. 4, 2009; the prior application is herewith incorporated by reference in its entirety.

BACKGROUND OF THE INVENTION

Field of the Invention

The present invention relates to a printing unit containing a dampening unit and an inking unit which includes a screen roller with a circumference and an ink applicator roller with a circumference and a gap with an arc length or curve length, the ink applicator roller contacting the circumference of the screen roller.

Published, European patent application EP 0 870 609 A2 and published, non-prosecuted German patent application DE 10 2006 050 746 A1 disclose printing units of this type. A disadvantage of the prior art printing units is that the gap causes the formation of ghost images which create visible disturbances in the printed image. In the region of the gap, the ink applicator roller does not accept ink from the screen roller. The dampening fluid proportion of the ink or, to be more accurate, of the emulsion that remains in the screen roller region that corresponds to the gap differs from that of the emulsion on the rest of the screen roller. If this corresponding region rolls on the ink applicator in an area that is outside the gap, the ghost image from the corresponding area is transferred to the ink applicator roller.

In the context of the present invention, the inventors realized that an accumulation of the ghost images is particularly detrimental. If during one revolution of the ink applicator roller and the screen roller the ghost image is re-transferred to the ink applicator roller and a further ghost image is transferred from the screen roller to the ink applicator roller during the next revolution and if these two ghost images that have been re-transferred overlap on the ink applicator roller, the resultant disturbances in the printed image are particularly noticeable.

SUMMARY OF THE INVENTION

It is accordingly an object of the invention to provide a printing unit which overcomes the above-mentioned disadvantages of the prior art devices of this general type, which has a particularly low level of ghosting.

With the foregoing and other objects in view there is provided, in accordance with the invention a printing unit. The printing unit contains a dampening unit, and an inking unit having a screen roller with a circumference $U_{RW}$ and an ink applicator roller with a circumference $U_{FA}$ and a gap having an arc length or curve length $K_{BL}$. The ink applicator roller rests against the screen roller. The screen roller and the ink applicator roller including the gap being dimensioned such that for $U_{RW}<U_{FA}$ and an integer $n\geqq 1$, the following applies:

$$n\times U_{RW}+K_{BL}\leqq U_{FA};$$

$$(n+1)\times U_{RW}\geqq U_{FA}+K_{BL};$$

$$3\times K_{BL}\leqq U_{FA};\text{ and}$$

$$2\times K_{BL}\leqq U_{RW}.$$

The printing unit of the invention includes a dampening unit and an inking unit, which contains an anilox or screen roller having a circumferential length and an ink applicator roller having a circumferential length and resting against the screen roller. The circumferential surface of the ink applicator roller has a gap which has a arc length or curve length to be measured in the direction of the circumference of the ink applicator roller. In the printing unit of the invention, the dimensions of the screen roller and of the ink applicator roller including the gap are chosen such that the circumferential length of the screen roller is less than the circumferential length of the ink applicator roller and such that, for an integer n, n being equal to or greater than 1, the following conditions apply: the sum of the arc length or curve length of the gap and the n-fold of the screen roller circumference is less than or equal to the circumference of the ink applicator roller. The (n+1)-fold of the screen roller circumference is greater than or equal to the sum of the circumference of the ink applicator roller and the arc length or curve length of the gap. The threefold of the arc length or curve length of the gap is less than or equal to the circumference of the ink applicator roller. Twice the arc length or curve length of the gap is less than or equal to the screen roller circumference.

An advantage of the printing unit of the invention is that the circumferential length of the screen roller relative to the circumferential length of the ink applicator roller and thus the diameter of the screen roller relative to the diameter of the ink applicator roller are matched in such a way that during the revolution of the ink applicator roller immediately following the revolution in which the ghost image has been created, the ghost image created by the dampening fluid or rather by the dampening fluid/printing ink emulsion on the screen roller rolls on the ink applicator roller in a circumferential region that is entirely outside the gap. Thus it is absolutely impossible for the gap-related ghost image transferred in one revolution to be overwritten by a new gap-related ghost image in the following revolution. Consequently, there can be no ghost images that overlap completely or partially, accumulate, and form visible stripes in the printed image. Such stripes are effectively avoided in the printing unit of the invention. In the printing unit of the invention, the roll-off relationships are matched to an optimum degree so that the gap of the ink applicator roller does not become visible in the printed image. After one revolution of the ink applicator roller, the image of the gap on the screen roller does not meet the gap of the ink applicator roller, not even partly. Thus the flaw that the gap of the ink applicator roller creates on the screen roller is prevented from accumulating on the screen roller and from developing into stripes that are visible in the printed image.

In accordance with a further development of the printing unit of the invention the gap is a lock-up gap for a roller cover of the rubber blanket type. When the roller cover is worn, an operator can easily change it. In the lock-up gap there is a lock-up or tensioning device for tensioning the roller cover. An operator may fasten both ends of the roller cover on the tensioning device.

In accordance with yet a further development the printing unit includes a printing form cylinder with a circumference that is equal to the circumference of the ink applicator roller. As a consequence, the gap of the ink applicator roller and the gap of the printing form cylinder roll on each other and the two gaps cannot create any ghost image.

In accordance with yet a further development, the dampening unit is a roller-type dampening unit including a dampening fluid applicator roller which rolls on the printing form cylinder during printing. Strictly speaking, designing the anilox printing unit in accordance with the invention is also advantageous if the dampening unit is of a different configuration, for example a spray-type dampening unit. However, a roller-type dampening unit is advantageous in terms of a particularly even dampening fluid supply and in terms of the formation of a stable emulsion.

The rollers of an anilox printing unit that does not have a dampening unit and thus operates in accordance with what is known as waterless dry-offset printing may be provided with rollers that are dimensioned in accordance with the invention. However, such an arrangement is not necessary for a printing unit of this type because it is the presence of the dampening fluid which creates the danger of truly detrimental ghosting.

Other features which are considered as characteristic for the invention are set forth in the appended claims.

Although the invention is illustrated and described herein as embodied in a printing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
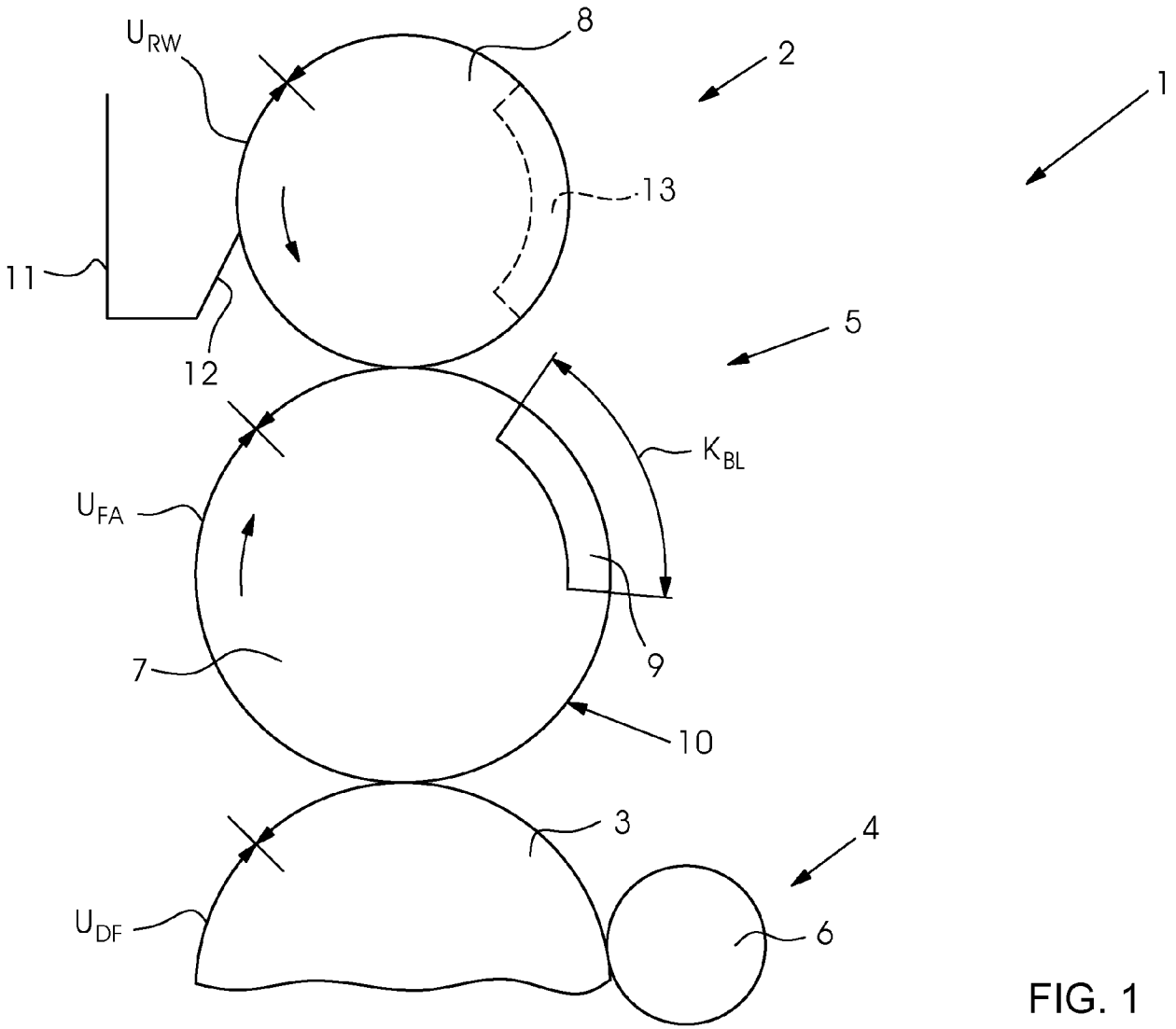
FIG. 1 is a diagrammatic, illustration of a printing unit including an anilox inking unit and a dampening unit.

In FIGS. 1 to 5, corresponding components and elements are identified by identical reference numerals.

Referring now to the figures of the drawing in detail and first, particularly, to FIG. 1 thereof, there is shown a section of a printing press 1 for lithographic offset printing on sheets. The section illustrates part of a printing unit 2 of the printing press 1. The printing unit contains a printing form cylinder 3, a dampening unit 4 for dampening the printing form cylinder 3 and an inking unit 5 for inking the printing form cylinder 3. The printing form cylinder 3 has an outer circumference $U_{DF}$. The dampening unit 4 is a roller-type dampening unit. In addition to a fountain roller, a metering roller, and a vibrator roller, which are not illustrated in the drawing, the dampening unit includes a dampening fluid applicator roller 6 which rests against the printing form cylinder 3 during printing. The inking unit 5 contains an ink applicator roller 7, which likewise rests against the printing form cylinder 3 during printing, and furthermore a screen roller 8, which rests against the ink applicator roller 7. The ink applicator roller 7 has an outer circumference $U_{FA}$, which is the same as the circumference $U_{DF}$ of the printing form cylinder 3. The printing form cylinder 3 and the ink applicator roller 7 consequently have the same outer diameter. The ink applicator roller 7 has a gap 9 which accommodates a non-illustrated lock-up or tensioning device. The tensioning device is used to attach a roller cover 10 to the ink applicator roller 7. Thus the gap 9 is a lock-up or tensioning gap. The gap 9 has an arc length or curve length $K_{BL}$, which is to be measured in the direction of the circumference. A circumference $U_{RW}$ of the screen roller 8 is different from the circumference $U_{FA}$ of the ink applicator roller 7. Thus the outer diameter of the screen roller 8 differs from the outer diameter of the ink applicator roller 7. More specifically, the circumference $U_{RW}$ of the screen roller 8 is less than the circumference $U_{FA}$ of the ink applicator roller 7. During printing, an ink fountain 11 having a single blade 12 is in contact with the screen roller 8. The fountain 11 is open to the environment and is not pressurized. Reference numeral 13 designates a ghost image caused by the gap 9. The ghost image 13 is an image of the gap 9 on the screen roller 8 and is congruent with the gap 9. In the region of the gap 9, the ink applicator roller 7 does not receive printing ink or emulsion from the depressions (cells or cups) of the screen roller 8 so that in the region of the ghost image 13 the proportion of dampening fluid decreases and the ghost image 13 is formed.

Figure 2:
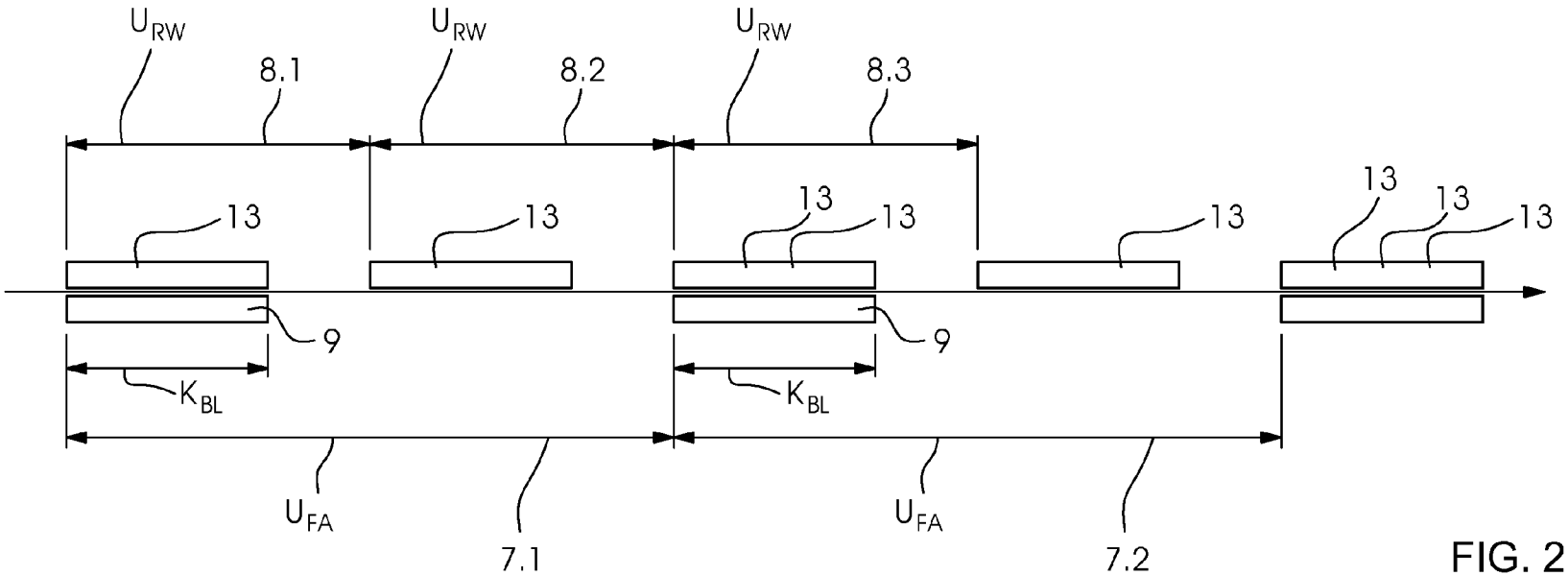
FIG. 2 PRIOR ART
FIG. 2 is a diagrammatic representation of roller roll-off relationships when the printing unit of FIG. 1 is configured in accordance with the prior art.

FIG. 2 illustrates the effect the ghost image 13 has when the printing unit 2 of FIG. 1 is configured in accordance with the prior art instead of in accordance with the invention. FIG. 2 illustrates how the ink applicator roller 7 and the screen roller 8 roll on each other in a direction of rotation from the left to the right as indicated by the arrow. FIG. 2 is based on the assumption that the circumference $U_{RW}$ of the screen roller 8 is exactly half of the circumference $U_{FA}$ of the ink applicator roller 7. A first revolution of the ink applicator roller is designated by reference numeral 7.1, and a second revolution of the ink applicator roller 7 immediately following the first revolution 7.1 is indicated by reference numeral 7.2. In an analogous manner, reference numerals 8.1, 8.2 and 8.2 designate three revolutions of the screen roller 8 in immediate succession. As can be seen, at the beginning of the second revolution 7.2 of the ink applicator roller 7, the gap 9 entirely coincides with the ghost image 13 that has been created on the screen roller 8 during the first revolution 7.1. In the process, a further ghost image 13 is superposed over the first ghost image 13, which is thus enhanced. This effect is very detrimental and should be implicitly avoided.

Figure 3:
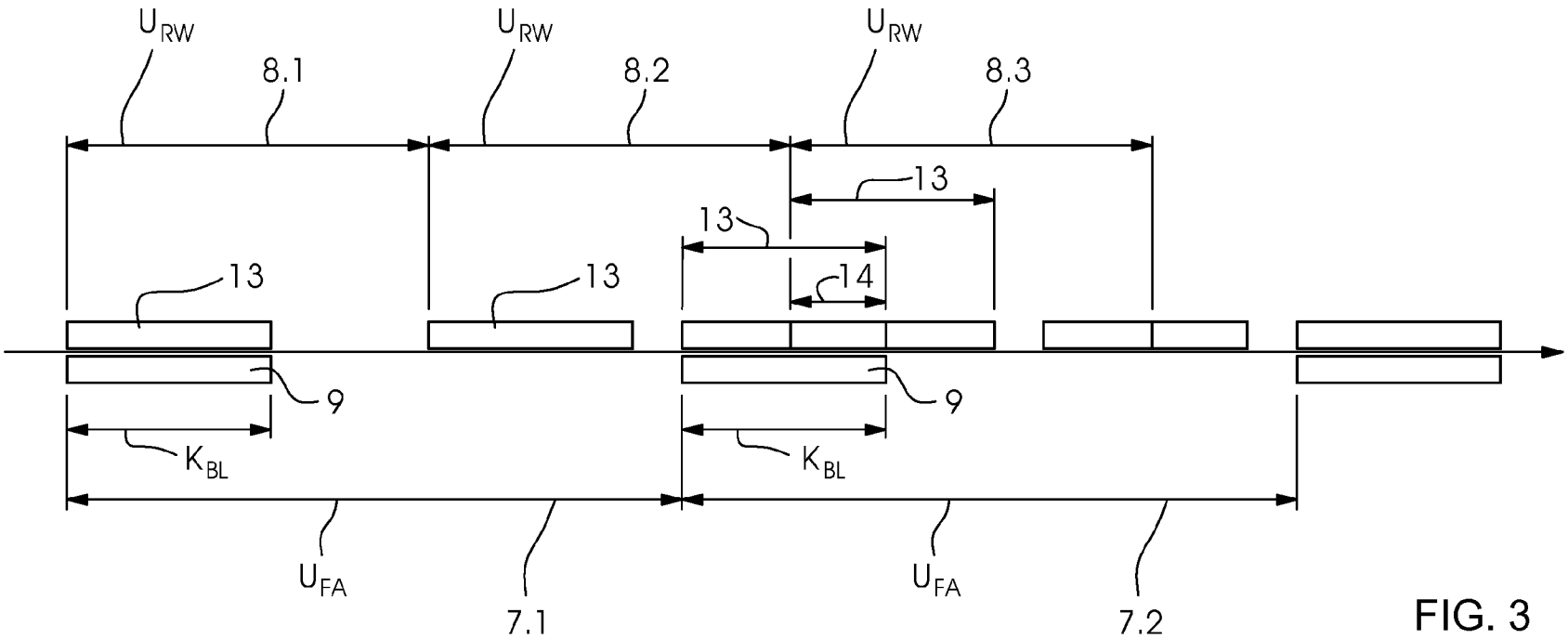
FIG. 3 PRIOR ART
FIG. 3 is a diagrammatic representation of the roller roll-off relationships when the printing unit of FIG. 1 is configured in accordance with a different prior art arrangement.

FIG. 3 illustrates the effects of the ghost image 13 when the printing unit 2 of FIG. 1 is arranged in accordance with a different configuration of the prior art. FIG. 3 is based on the assumption that the circumference $U_{RW}$ of the screen roller 8 is more than half of the circumference $U_{FA}$ of the ink applicator roller 7. As can be seen, the ghost image 13 created on the screen roller 8 by the gap 9 during the second revolution 7.2 of the ink applicator roller 7 only partially overlaps with the ghost image 13 that the gap 9 left on the screen roller 8 during the first revolution 7.1. The ghost image 13 created by the first revolution 7.1 and the ghost image 13 created by the second revolution 7.2 overlap in an overlap region 14. In this overlap region 14, the negative effects of the ghost image 13 are enhanced, i.e. the dampening fluid content in the emulsion on the screen roller 8 is particularly low in the overlap region 14. The ghost image 13 created by the first revolution 7.1 did not have time to recover, i.e. to absorb more dampening fluid by rolling on a circumferential region of the ink applicator roller 7 outside the gap 9, before the preceding ghost image 13 was overwritten by the following ghost image 13. This overwriting or superposing of ghost images is highly detrimental to the quality of the printed image.

Figure 4:
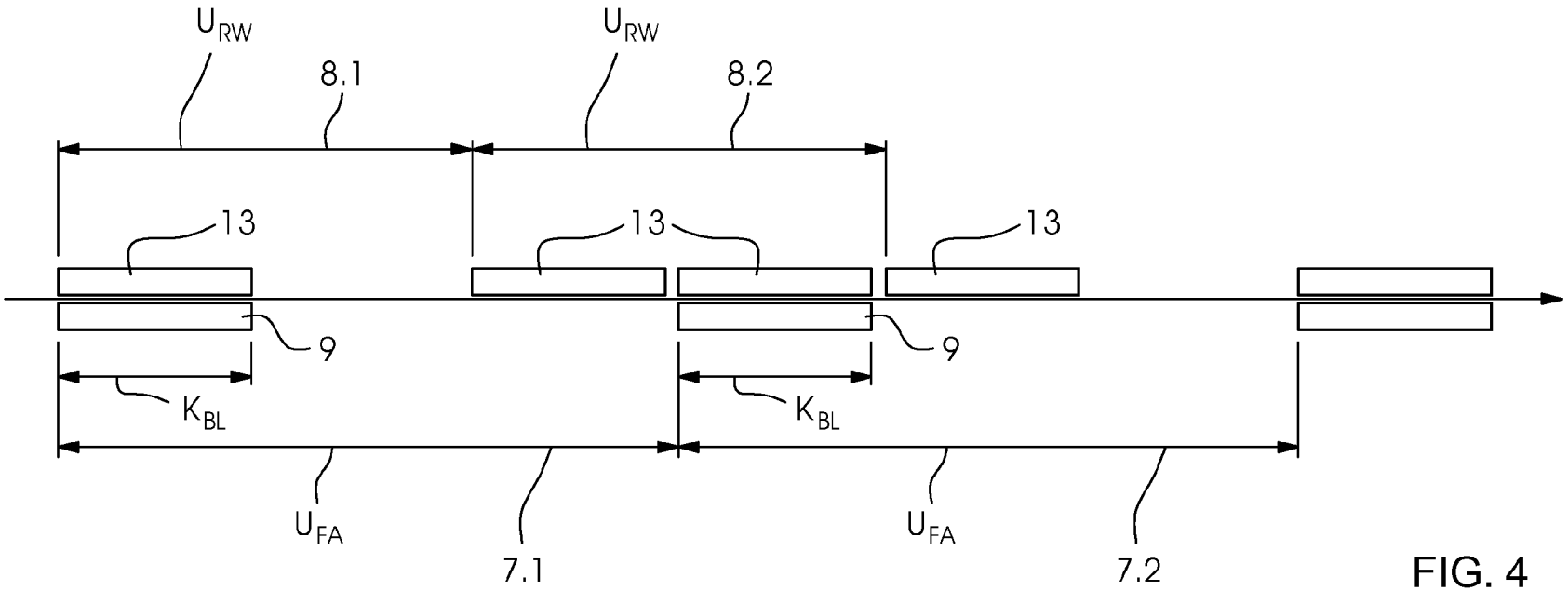
FIG. 4 is a diagrammatic representation of the roller roll-off relationships when the printing unit of FIG. 1 is configured in accordance with a first embodiment of the invention.
Figure 5:
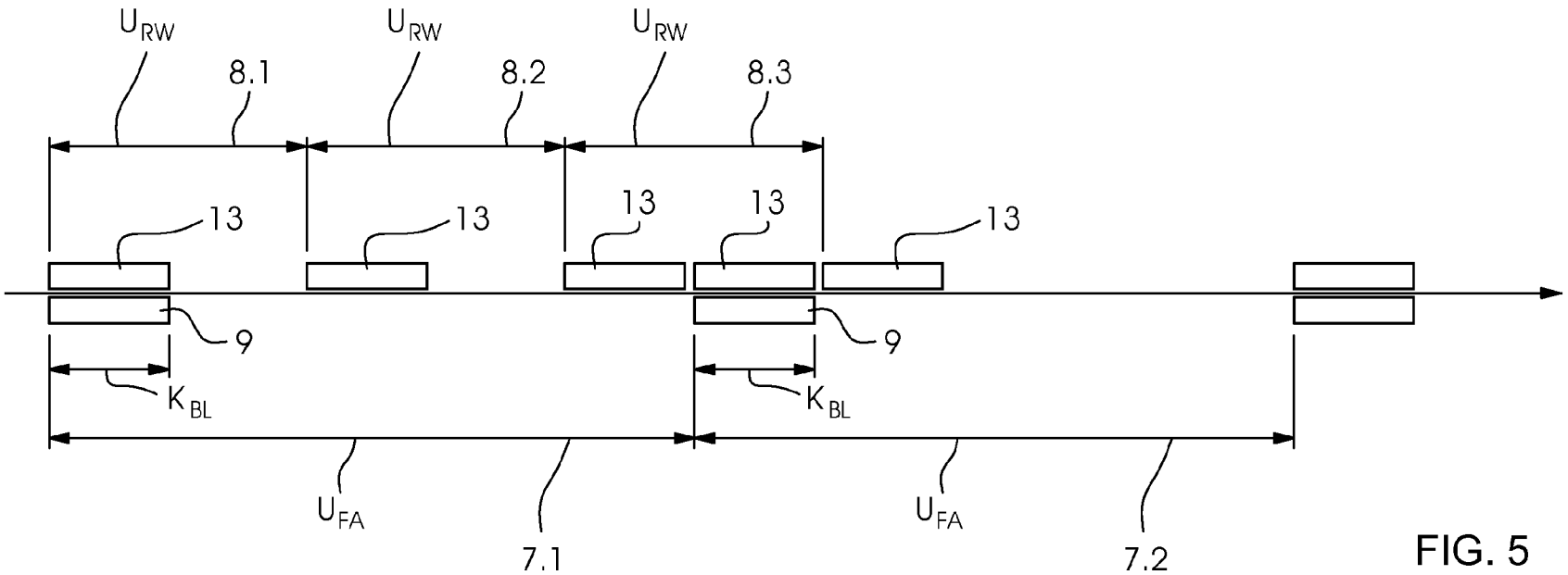
FIG. 5 is a diagrammatic representation of the roller roll-off ratios when the printing unit of FIG. 1 is configured in accordance with a second embodiment of the invention.

FIGS. 4 and 5 illustrate two exemplary embodiments in which the printing unit 2 of FIG. 1 is dimensioned in accordance with the invention to avoid the detrimental ghost image overlap explained with reference to FIGS. 2 and 3.

For both embodiments illustrated in FIGS. 4 and 5 the following size ratios apply.

$$U_{RW}<U_{FA}$$

Thus the circumferential length of the screen roller 8 is less than the circumferential length of the ink applicator roller 7.

$$n\times U_{RW}+K_{BL}\leqq U_{FA}$$

The sum of the arc length or curve length of the gap 9 and of the product out of the integer n and the circumference of the screen roller 8 is less than or equal to the circumference of the ink applicator roller 7.

$$(n+1)\times U_{RW}\geqq U_{FA}+K_{BL}$$

The product out of the circumference of the screen roller 8 and the sum of the integer n plus 1 is greater than or equal to the sum of the circumference of the ink applicator roller 7 and the arc length or curve length of the gap 9.

$$3\times K_{BL}\leqq U_{FA}$$

Three times the arc length or curve length of the gap 9 is less than or equal to the circumference of the ink applicator roller 7.

$$2\times K_{BL}\leqq U_{RW}$$

Twice the arc length or curve length of the gap 9 is less than or equal to the circumference of the screen roller 8.

$$n\geqq 1$$

The integer n is greater than or equal to 1.

The exemplary embodiment given in FIG. 4 is based on the assumption that the circumference $U_{RW}$ of the screen roller 8 is more than half of the circumference $U_{FA}$ of the ink applicator roller 7. As a result of the fact that the screen roller 8 and the ink applicator roller 7 are dimensioned in accordance with the formulas given above, the former rolls on the latter in such a way that the gap image (ghost image 13) dragged along by the screen roller 8 rolls in front of the gap 9 during the second revolution 7.2 of the ink applicator roller 7 and does not overlap with the gap 9 at all. Therefore, the flaw created by the gap 9 contacts the screen roller 7 in a location that has been flawless up to this point. Thus the flaw does not accumulate and remains invisible in the printed image. After the second revolution 8.2 of the screen roller 8, the flaw becomes even weaker until it is completely dissipated and at some time, the gap 9 again rolls on the circumferential location of the screen roller 8 on which the flaw had been.

The exemplary embodiment of FIG. 5 is based on the assumption that the circumference $U_{RW}$ of the screen roller 8 is less than half of the circumference $U_{FA}$ of the ink applicator roller 7. Thus the gap image (ghost image 13) that is being dragged along may even roll twice on the ink applicator roller 7. If the gap image then passes the gap 9 of the ink applicator roller 7 as shown in FIG. 5, the gap image on the screen roller 8 will roll on several times without disturbance and will thus be completely dissipated at this location.

An inherent aspect of both exemplary embodiments illustrated in FIGS. 4 and 5 is that the ghost image 13 created during the second revolution 7.2 of the ink applicator roller 7 by the gap 9 of the ink applicator roller 7 is placed entirely between two ghost images 13 on the screen roller 8, i.e. that the ghost image 13 created during the second revolution 7.2 does not coincide with another ghost image 13 and does not even overlap with such a ghost image 13. This fact prevents the flaw left on the screen roller 8 by the gap 9 of the ink applicator roller 7 from accumulating and developing into a stripe that is visible in the printed image.

An additional advantage is that the printing unit 2 of the printing press 1 of the invention can be cleaned especially quickly because the gap 9 no longer has such a disruptive effect on the distribution of the cleaning fluid.

The invention claimed is:

1. A printing unit, comprising:

a dampening unit; and an inking unit having a screen roller with a circumference $U_{RW}$ and an ink applicator roller with a circumference $U_{FA}$ and a gap having an arc length or curve length $K_{BL}$, said ink applicator roller resting against said screen roller, said screen roller and said ink applicator roller including said gap being dimensioned such that for $U_{RW}<U_{FA}$ and an integer $n\geqq 1$, the following applies:

$$n\times U_{RW}+K_{BL}\leqq U_{FA};$$

$$(n+1)\times U_{RW}\geqq U_{FA}+K_{BL};$$

$$3\times K_{BL}\leqq U_{FA};\text{ and}$$

$$2\times K_{BL}\leqq U_{RW}.$$

2. The printing unit according to claim 1, wherein said gap is a lock-up gap for a roller cover of a type of a rubber blanket.

3. The printing unit according to claim 1, further comprising a printing form cylinder having a circumference $U_{DF}$ and said circumference $U_{FA}$ of said ink applicator roller is equal to said circumference $U_{DF}$ of said printing form cylinder.

4. The printing unit according to claim 1, wherein said dampening unit is a roller-type dampening unit including a dampening unit roller.

* * * * *